United States Patent [19]

Chandhok et al.

[11] Patent Number: 5,047,205

[45] Date of Patent: Sep. 10, 1991

[54] METHOD AND ASSEMBLY FOR PRODUCING EXTRUDED PERMANENT MAGNET ARTICLES

[75] Inventors: Vijay K. Chandhok, Pittsburgh; Robert F. Krause, Murrysville; Bao-Min Ma, Pittsburgh, all of Pa.; John J. DuPlessis, Elizabethtown, Ky.

[73] Assignee: Crucible Materials Corporation, Pittsburgh, Pa.

[21] Appl. No.: 338,447

[22] Filed: Apr. 14, 1989

Related U.S. Application Data

[63] Continuation of Ser. No. 122,351, Nov. 18, 1987, abandoned.

[51] Int. Cl.[5] ..... B22F 7/00

[52] U.S. Cl. ..... 419/8; 419/24; 419/31; 419/41; 419/48

[58] Field of Search ..... 419/8, 24, 31, 41, 48

[56] References Cited

U.S. PATENT DOCUMENTS 4,704,249 11/1987 Glatzle ..... 419/4

4,729,789 3/1988 Ide et al. ..... 419/8

*Primary Examiner*—Stephen J. Lechert, Jr.

*Attorney, Agent, or Firm*—Finnegan, Henderson, Farabow, Garrett & Dunner

[57] ABSTRACT

A method for producing a compacted fully dense permanent magnet by providing a particle charge of a permanent magnet alloy composition from which the article is to be made and placing the charge in a cylindrical container having a generally axially positioned core with the charge surrounding the core within the container. The container and charge are heated to an elevated temperature and extruded to compact the charge to a substantially fully dense permanent magnet article.

20 Claims, 2 Drawing Sheets

METHOD AND ASSEMBLY FOR PRODUCING EXTRUDED PERMANENT MAGNET ARTICLES

This application is a continuation of application Ser. No. 122,351, filed Nov. 18, 1987, abandoned.

BACKGROUND OF THE INVENTION

1. Field of the Invention

This invention relates to a method and assembly for producing extruded permanent magnet articles from particle charges of permanent magnet alloys.

2. Description of the Prior Art

It is known to produce permanent magnet articles by powder metallurgy techniques, which include the consolidation of particles of the permanent magnet alloys. These practices are employed with permanent magnet alloys of at least one rare earth element and transistion element. These conventional practices generally include the steps of aligning, pressing and sintering. With prior art practices of this type, high energy product ($BH_{max}$) and uniaxial anisotropic crystal alignment is achieved, and this combination finds utility in various permanent magnet applications.

Uniaxial anisotropic crystal alignment, however, is not always advantageous for magnet applications for rotating machinery, motor rotors, beam focusing devices and the like. For these applications a [100] fiber texture wherein the C crystallographic axis is perpendicular to the axis of the magnet may be desired. One of the primary applications for magnets of this construction is for use in DC motors. In this application, with conventional practice, multiple segments of uniaxial anistropic magnets are needed to form the armature for the motor, which segments are identified as 2 positioned around a motor shaft 4 in FIG. 1.

To obviate the need for the use of a plurality of magnet segments, as shown in FIG. 1, it is known to extrude a cylindrical magnet conforming to the required dimensions of the motor shaft. An extruded magnet 6 in association with a motor shaft 4 is shown in FIG. 2.

Cylindrical, extruded magnets, as shown in FIG. 2, are conventionally produced by the use of a cylindrical extrusion container. Magnet alloy particles are introduced to the container, and the container is outgassed, evacuated and sealed. Thereafter, the container is heated to extrusion temperature and extruded to consolidate the particles to substantially full density. The hollow center of the magnet is achieved by the use of a solid cylinder or mandrel of a diameter corresponding to the internal diameter of the magnet to be produced, which cylinder is attached to the extrusion ram. This solid cylinder moves with the extrusion ram during the extrusion operation and thereby maintains the desired inner diameter of the extruded magnet. It is difficult to maintain concentricity of the inner and outer peripheries of the extruded magnet because the mandrel tends to wander and thus is not maintained in axial alignment during the extrusion operation. In addition, at the high extrusion ratios breaking of the mandrel may occur. It may be seen, therefore, that in producing cylindrical magnets by conventional extrusion practices, a cylindrical magnet having the required concentric dimensions is difficult to achieve.

OBJECTS AND SUMMARY OF THE INVENTION

It is accordingly a primary object of the present invention to provide an extrusion method and assembly for use therewith that achieves improved concentricity in the production of extruded hollow cylindrical magnets.

A more specific object of the invention is a method and assembly for use therewith that enables the production of a complete assembly, including a permanent magnet and associated shaft in a single extrusion operation.

Broadly, in accordance with the method of invention for producing a compacted fully dense permanent magnet article, a particle charge is provided of a permanent magnet alloy composition from which the permanent magnet article is to be made. The particle charge is placed in a cylindrical container having a generally axially positioned core with the charge surrounding the core within the container. The container is evacuated and sealed against the atmosphere. The container and particle charge are heated to elevated temperature and the container and charge are then extruded to compact the charge to substantially full density to thereby produce a substantially fully dense permanent magnet article.

To facilitate removal of the core to produce the desired cylindrical magnet article, a separating medium, such as magnesium oxide, may be provided on the core. The core may be of carbon steel, a soft magnet material or stainless steel. During the extrusion operation, the core may be bonded to the permanent magnet alloy. This is advantageous from the standpoint of producing a unitary magnet and shaft assembly during the extrusion operation.

Extrusion ratios within the range of 1.5:1 to 50:1 may be employed with extrusion temperatures within the range of 500° to 1200° C.

The method of the invention finds particular use in producing rare earth element containing permanent magnets. More specifically, it may be used in the production of magnets of this type wherein at least one rare earth element, such as samarium, neodymium and dysprosium, may be used with a transition element, such as iron and cobalt, plus boron and/or carbon.

The invention for use in producing a compacted, fully dense permanent magnet article by extrusion includes a cylindrical container having a core generally axially positioned therein. The mandrel defines an annular chamber within the container. A particle charge of a permanent magnet alloy from which the article is to be made is provided within this annular chamber. Means are provided for sealing the annular chamber.

A separating medium may be provided on the core. This facilitates removal of the core from the compacted magnet after extrusion. The core may be constructed of carbon steel, a soft magnet material or stainless steel.

DETAILED DESCRIPTION OF THE PREFERRED EMBODIMENTS

Figure 3:
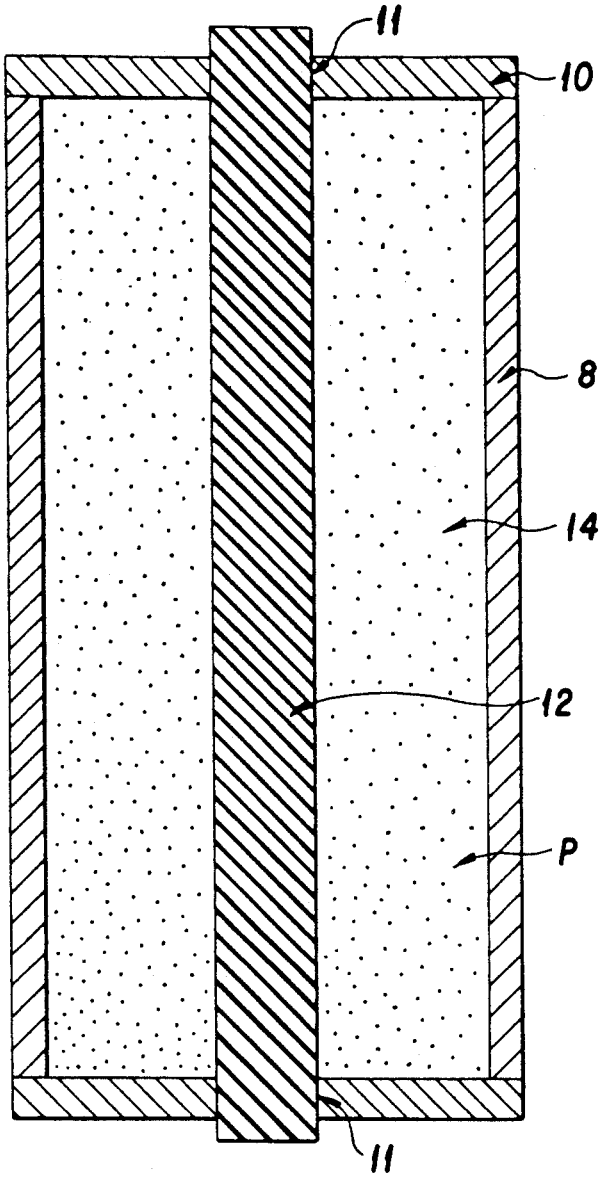
FIG. 3 shows in vertical cross-section an embodiment of an assembly in accordance with the invention for use in the method thereof to produce an extruded magnet.
Figure 4:
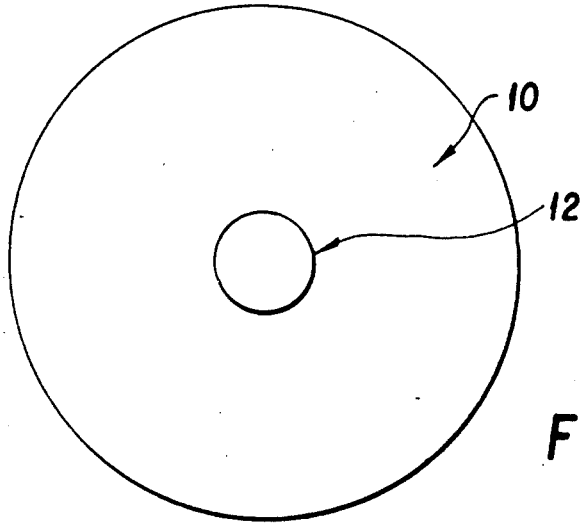
FIG. 4 is a top view of the assembly of FIG. 3.

In accordance with one embodiment of the invention, with reference to FIGS. 3 and 4, there is shown a cylindrical container 8 having end plates 10 with axial openings 11 connected at opposite ends of the container, as by welding (not shown) to seal the container. A solid core 12 is connected at opposite ends thereof to the plates 10 and a portion extends through openings 11. The core is axially positioned within the container 8 to define therein an annular chamber 14 surrounding the core. Particles P of the magnet alloy composition from which the magnet is to be constructed are provided within the annular chamber 14 of the container 8.

Figure 1:
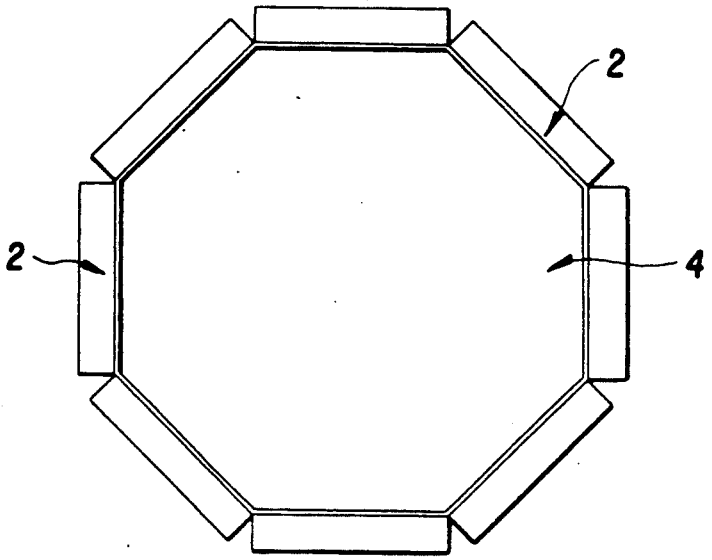
FIG. 1 PRIOR ART
FIG. 1 shows a conventional assembly of permanent magnet segments in association with a motor shaft.
Figure 2:
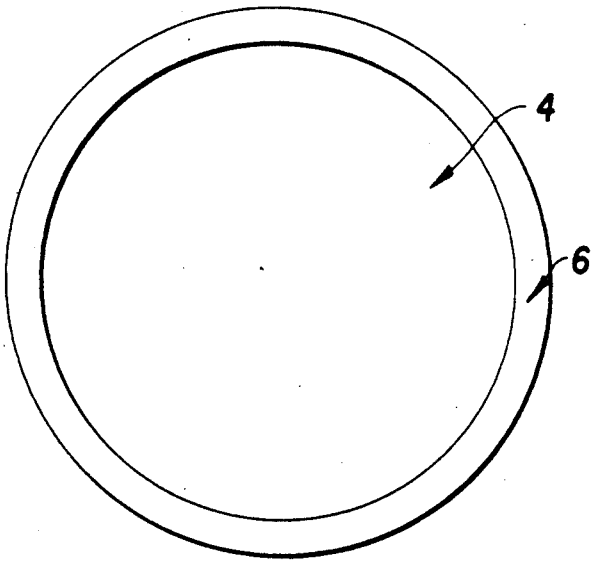
FIG. 2 shows a conventional assembly of a motor shaft and an associated cylindrical permanent magnet.

The assembly of FIGS. 3 and 4 so constructed is then after outgassing heated to extrusion temperature and extruded in conventional extruding apparatus to compact the particles in the container to substantially full density. Thereafter, the core 12 may be removed from the compacted hollow cylindrical magnet. This may be faclitated by having the core provided with a separating medium, such as magnesium oxide, on the surface thereof. Alternately, the core may be bonded to the cylindrical magnet for use as an assembly in the production of a conventional motor rotor, as shown in FIG. 2.

EXAMPLE 1

A carbon steel extrusion container was made with a solid low-carbon rod, ¾" in diameter, welded axially to the top and bottom plates of a mild carbon steel can. Atomized $(NdDy)_{15}Fe_{79}B_6$ powder was put into the 3⅛" diameter can and the can was heated to 150° C., evacuated and sealed. The container was then heated to 927° C. and extruded with a ratio of 13.8:1. The final extrusion consisted of a 0.3" diameter steel rod surrounded by a ring shaped magnet with a wall thickness of about 0.25". The magnetic properties are listed in Table 1. The identical properties along two orthogonal directions perpendicular to the extrusion direction indicates that a [100] fiber texture is obtained. This is the same magnetic behavior as is observed for magnets extruded by conventional methods.

These extruded magnets, with rods at their centers, can directly be magnetized into multiple poles and used for any type of rotating assembly.

TABLE 1

| Sample Designation | Test Direction | Br kG | Hc kOe | Hci kOe | BHmax MGOe |
|---|---|---|---|---|---|
| EX-267 | Axial | 3.8 | 3.3 | 15.3 | 3.1 |
| | Transverse 1 | 7.3 | 6.4 | 15.8 | 12.3 |
| | Transverse 2 | 7.2 | 6.3 | 15.7 | 11.6 |

EXAMPLE 2

To compare the practice of Example 1 with a conventional practice, the identical powder used in Example 1, $(NdDy)_{15}Fe_{79}B_6$, was placed into a 3⅛" diameter can and the can was heated to 150° C., evacuated and sealed. The can was then heated to 927° C. and extruded with a ratio of 13.8:1. The magnetic properties of the resultant solid cylinder are presented in Table II. The magnetic properties are very similar to those obtained in Example 1. Thus, the extrusion technique of Example 1 in accordance with the invention will produce magnetic properties comparable to a conventional magnet extrusion method.

TABLE II

| Sample Designation | Test Direction | Br kG | Hc kOe | Hci kOe | BHmax MGOe |
|---|---|---|---|---|---|
| EX-235 | Axial | 3.6 | 3.1 | 13.9 | 2.7 |
| | Transverse 1 | 7.1 | 6.1 | 14.0 | 10.9 |
| | Transverse 2 | 7.1 | 6.1 | 14.1 | 11.0 |

EXAMPLE 3

The same powder as used in Examples 1 and 2 was placed in a carbon steel extrusion container. This extrusion container was in the shape of a hollow circular cylinder, 3⅛" OD and ¾" ID. The container was evacuated, sealed and heated to 927° C. and extruded at a 10:1 extrusion ratio. The inner diameter was maintained during extrusion by affixing a solid mandrel to the ram of the extrusion press in accordance with conventional practice. The magnetic properties, Table III, are similar to the properties presented in Tables I and II. The concentricity defined as the ratio of minimum to maximum wall thickness, was calculated to be 0.90. This value is poorer than the concentricity, 0.95, measured on the sample extruded in Example 1 in accordance with the invention.

TABLE III

| Sample Designation | Test Direction | Br kG | Hc kOe | Hci kOe | BHmax MGOe |
|---|---|---|---|---|---|
| EX-261 | Axial | 3.5 | 3.0 | 14.4 | 2.6 |
| | Transverse | 7.4 | 6.5 | 16.5 | 12.4 |

As may be seen from the above descriptions and Examples, the invention provides for the production of a hollow permanent magnet by an extrusion practice wherein the desired dimensions of the magnet may be maintained while achieving permanent magnet properties comparable to conventional practices used for this purpose.

It is to be understood that the shape of the core may include symmetrical geometries other than cylindrical. The particles of magnetic material for compaction may be produced by atomization, rapidly solidified ribbon, cast and pulverized particles, direct cast ingots or particles made by a reduction-diffusion practice.

Since the core may be bonded to the compacted magnet during extrusion, an assembly may be produced having an outer shell of a permanent magnet alloy and a soft magnetic inner core, with the inner core acting to direct magnetic flux.

What is claimed is:

1. A method for producing a compacted fully dense permanent magnet, said method comprising:

providing a particle charge of a permanent magnet alloy composition from which said article is to be made;

placing said charge in a cylindrical container having a generally axially positioned core with said charge surrounding said core within said container; and heating said container and charge to an elevated temperature and extruding said container and charge to simultaneously compact said charge to form a substantially fully dense permanent magnet article having substantially identical magnet properties along two orthogonal directions perpendicular to the extrusion direction to achieve a fiber texture.

2. The method of claim 1 wherein said core is removed after compacting.

3. The method of claim 1 wherein a separating medium is provided on said core.

4. The method of claim 1 wherein said core is carbon steel.

5. The method of claim 1 wherein said core is a soft magnetic material.

6. The method of claim 1 wherein said core is stainless steel.

7. The method of claim 1 wherein said core is bonded to said permanent magnet alloy during said extrusion.

8. The method of claim 1 wherein said extruding is performed with an extrusion ratio within the range of 1.5:1 to 50:1.

9. The method of claim 1 wherein said extruding is performed with said charge at a temperature within the range of 500° to 1200° C.

10. The method of claim 1 wherein said extruding is performed with an extrusion ratio within the range of 1.5:1 to 50:1 and with said charge at a temperature within the range of 500° to 1200° C.

11. A method for producing a compacted fully dense permanent magnet, said method comprising:

providing a particle charge of a permanent magnet alloy comprising at least one rare earth element, from which said article is to be made;

placing said charge in a cylindrical container having a generally axially positioned core with said charge surrounding said core within said container; and heating said container and charge to an elevated temperature and extruding said container and charge to simultaneously compact said charge to substantially full density to produce a substantially fully dense permanent magnet article having substantially identical magnet properties along two orthogonal directions perpendicular to the extrusion direction to achieve a fiber texture.

12. The method of claim 11, wherein said core is removed after compacting.

13. The method of claim 11, wherein a separating medium is provided on said core.

14. The method of claim 11 wherein said core is carbon steel.

15. The method of claim 11 wherein said core is a soft magnetic material.

16. The method of claim 11 wherein said core is a stainless steel.

17. The method of claim 11 wherein said core is bonded to said permanent magnet alloy during said extrusion.

18. The method of claim 11 wherein said extruding is performed with an extrusion ratio within the range of 1.5:1 to 50:1.

19. The method of claim 11 wherein said extruding is performed with said charge at a temperature within the range of 500° to 1200° C.

20. The method of claim 11 wherein said extruding is performed with an extrusion ratio within the range of 1.5:1 to 50:1 and with said charge at a temperature within the range of 500° to 1200° C.

* * * * *

UNITED STATES PATENT AND TRADEMARK OFFICE

CERTIFICATE OF CORRECTION

PATENT NO. : 5,047,205

DATED : September 10, 1991

INVENTOR(S) : Vijay K. CHANDHOK et al.

It is certified that error appears in the above-identified patent and that said Letters Patent is hereby corrected as shown below:

Claim 1, column 4, line 68, before "fiber" insert --[100]--.

Claim 11, column 6, line 8, before "fiber" insert --[100]--.

Signed and Sealed this

Ninth Day of March, 1993

*Attest:*

STEPHEN G. KUNIN

*Attesting Officer*

*Acting Commissioner of Patents and Trademarks*